United States Patent [19]

Katayama et al.

[11] Patent Number: 4,751,164

[45] Date of Patent: Jun. 14, 1988

[54] METHOD OF MAKING CARRIER FOR USE IN ELECTROPHOTOGRAPHIC DEVELOPERS

[75] Inventors: Mitsuhiro Katayama; Kenkichi Hara; Kazuyoshi Oka, all of Gunma, Japan; Ulf Engström, Höganäs; Svenn E. Larssen, Nyhamnsläge, both of Sweden

[73] Assignees: Kanto Denka Kogyo Co., Ltd., Tokyo, Japan; Höganäs AB, Höganäs, Sweden

[21] Appl. No.: 49,669

[22] Filed: May 13, 1987

Related U.S. Application Data

[62] Division of Ser. No. 871,798, Jun. 9, 1986.

[30] Foreign Application Priority Data

Jun. 10, 1985 [JP] Japan ..... 60-125462

[51] Int. Cl.[4] ..... G03G 9/10; G03G 9/14; G03G 21/00

[52] U.S. Cl. ..... 430/137

[58] Field of Search ..... 430/137

[56] References Cited

U.S. PATENT DOCUMENTS

| | | | |
|---|---|---|---|
| 3,632,512 | 1/1972 | Miller | 430/137 |
| 4,238,558 | 12/1980 | Ziolo | 430/137 X |
| 4,282,302 | 3/1981 | Makino et al. | 430/137 X |
| 4,468,445 | 4/1984 | Kelly et al. | 430/107 |
| 4,526,851 | 7/1985 | Boughton et al. | 430/108 X |

FOREIGN PATENT DOCUMENTS

| | | | |
|---|---|---|---|
| 0058013 | 3/1982 | European Pat. Off. . | |
| 58-91463 | 5/1983 | Japan | 430/137 |
| 2096176 | 4/1982 | United Kingdom . | |

OTHER PUBLICATIONS

Research Disclosure No. 154, Feb. 1977, pp. 36–38, Discl. No. 15439, "Electrographic Carrier Materials".

*Primary Examiner*—Roland E. Martin
*Attorney, Agent, or Firm*—Browdy and Neimark

[57] ABSTRACT

A novel carrier material useful in conjunction with a toner for preparing a two-component developer for electrophotographic processes is provided. The carrier comprises a spherical magnetite particulate material having a reduced metallic iron outer layer which is coated with an outermost resinous layer for conditioning the copying properties of the carrier.

3 Claims, No Drawings

METHOD OF MAKING CARRIER FOR USE IN ELECTROPHOTOGRAPHIC DEVELOPERS

This is a division of application Ser. No. 871,798, filed June 9, 1986.

FIELD OF THE INVENTION

This invention relates to particulate magnetite materials useful as carrier components in electrophotographic developers, in particular two-component developers comprising a carrier component together with a toner component. In particular, the invention relates to an electrophotographic carrier material comprising a spherical magnetite core surrounded by a reduced metallic iron layer and to a method for preparing the carrier material.

PRIOR ART

In electrophotography, the electrostatic latent image formed on a photoconductor is developed by the magnetic brush method using either a so called "one-component" developer or a "two-component" developer. Usually, the two-component developer system comprises a mixture of relatively fine particles of a toner and relatively coarse particles of a carrier. The toner particles are held on the carrier particles by the electrostatic forces of opposite polarities which are generated by friction between the particles. When the developer comes into contact with an electrostatic latent image formed on the photosensitive plate, the toner particles are attracted by the image and thus make the latter visible. The thus developed image is then transferred onto a recording medium, such as a paper sheet. In this porcess, therefore, the toner particles should be charged with an accurately controlled amount of static electricity so that they are preferentially attracted to the electrostatically imaged area of the photosensitive plate.

Thus, in turn, the carrier which is used in combination with the toner should fullfil the following criteria. The carrier shoud have an appropriate triboelectric property which enables it to electrostatically hold the toner particles and to transfer the toner particles held to the electrostatic lateant image on the photosensitive plate when contacted. The carrier should have a sufficient mechanical strength to prevent the carrier particles from breaking or cracking. The carrier particles should exhibit a good fluidity to promote the admixing thereof with the toner and to allow it to be smoothly transferred within the copying machine. The carrier particles should be uniform in their electric and magnetic properties. The carrier should be stable with respect to changes in the environmental conditions such as temperature and, in particular, humidity. The carrier particles should have a sufficient durability to ensure an acceptable lifetime.

Although the quality of copies developed by electrophotographic processes is largely governed by the type of copying machine employed, in particular the type of the developing process on which the copying machine is based, it is also known that the copy quality is affected to a significant extent by the developer used therein.

Therefore, various attempts to improve the carrier and toner materials constituting the developers have been made to ensure exact reproduction of an original.

Hitherto, carriers have been selected from a variety of materials. An example which has been most widely used is an iron (metalliac) powder of irregular particulate form or shape. Because the iron powder has a high level of saturation magnetization and anisotropy, the magnetic brush (i.e. a tuft of filaments comprising the carrier particles having the toner particles theron, each of the filaments being generally formed with the carrier particles chained together in one length by the magnetic forces generated by and transferred from the magnetoroll, and each filament standing on end from the surface of the sleeve of the magnetoroll) is necessarily longer and more firm than those obtained with other carrier materials of a lower saturation magnetization. This phenomenon may be often observed where the iron powder carrier is of a flat and irregular particulate shape. If the magnetic brush is long and firm, the density of the brush tuft will be low and hence it is difficult to produce a fine copy having a good gradient. In spite of the poor gradient of copy achieved by a developer comprising the iron powder carrier of irregular particulate shape, such a developer may be advantageous in that it is possible to generate a high degree of chromic density therewith. Therefore, this type of developer has been employed in a type of copying machine which is provided with a relatively wide clearance between the surface of the sleeve of the magnetoroll and the surface of the photoconductor.

On the other hand, in order to develop a fine copy of an improved gradient, a carrier comprising an iron powder of a spherical particulate shape has been employed. Since the iron particles are spherical and, thus, isotropic, the disadvantages which are caused by the anisotropy of the carrier comprising the irregularly shaped iron powder are significantly reduced by use of the spherical iron carrier. The magnetic brushes formed therefrom are remarkedly short and dense. Accordingly, the developing torque required is also reduced. However, this spherical iron powder is not completely satisfactory; since the carrier again comprises metallic iron and has a relatively high specific gravity and hence a relatively large apparent density (usually greater than 4.0 g/cm$^3$), the particles tend to jump or fly away and to cause difficulties in the process and machine. To prevent the escape of the particles, it is necessary to adopt a special and complicated design for the magnetoroll and related parts of the copying machine. Further, the heavy iron carrier may give rise to a high stress on the toner particles when admixed together and may adversely affect the working life of the developer. With this type of carrier, although it is possible to develop a relatively high quality of copies having an improved gradient, the copies generally tend to have a relatively low degree of chromic density. This undesirable tendency has been reduced or removed by appropriate modifications of the machine or by regulation thereof, for example, by increasing the electrostatic potential charged on the surface of the photoconductor.

It has been proposed to use ferrite, an oxidic ferromagnetic material, as a carrier material in an attempt to improve the copy quality and to prolong the working life of developer. Because the ferrite carrier has a saturation magnetization (about 40–70 emu/g) lower than that of iron powder (about 200 emu/g), the magnetic brush formed from the former is soft and thus fine copies of an improved gradient may be developed therewith. Further the ferrite carrier is advantageous in that the stress exerted on the toner particles is significantly reduced and consequently the durability of developer is prolonged, since the ferrite carrier has a specific gravity lower than that of metallic iron. The developing torque required is also reduced. Notwithstanding the above advantages, the ferrite carrier is used only within a limited range of application, because the electrical resistivity of ferrite is rather high. Further the ferrite material is relatively sensitive to environmental conditions so that the performance of the ferrite carrier tends to be significantly influenced by such changes in the environmental conditions as humidity variations and the resulting copy quality tends to change over the period of operation in which the ferrite carrier is used.

To improve the environmental stability of the ferrite carrier, it has been proposed that the ferrite carrier particles be provided with a resinous coating layer, although this further increases the undesirably high electrical resistivity of the material, resulting in a further limitation of the application range and additional production costs.

BRIEF EXPLANATION OF THE INVENTION

An object of the present invention is to provide a novel carrier material with which the problems associated with the known carriers are obviated or substantially removed.

Another object of the invention is to provide a method for preparing this novel carrier.

A further object of the invention is to provide a novel carrier which is effective in producing electrophotographic copies of excellent quality, is stable in respective of changes in environmental conditions, and has increased durability.

Accordingly, the invention provides a resin-coated particulate carrier material useful for preparing, in conjunction with a toner, a two-component electrophotographic developer, said carrier material consisting essentially of a core having a spherical body of magnetite surrounded by an outer surface layer comprising reduced metallic iron, and a resinous coating layer covering said core.

The invention also provides a method for preparing the above defined novel carrier material, comprising the steps of partially reducing a particulate magnetite material in a substantially spherical form with a gaseous reducing agent to give a layer of reduced metallic iron on the surface of said spherical magnetite material, and coating the thus partially reduced magnetite material with a resinous material.

The carrier material according to the invention has an outer surface layer comprising mettalic iron on the spherical magnetite core. Since this carrier has a significantly low electrical resistivity by virtue of the metallic layer, there is wide room for optionally increasing the resistivity over a wide range. The control of resistivity may be conveniently achieved by coating the material with a resinous insulating material. Therefore, it is possible to accommodate the resistivity to various types of copying machines and processes requiring different optimal levels of resistivity with respect to the carrier material.

As the carrier of the invention is prepared by reducing the spherical magnetite material, the resulting metallic surface layer is porous and will enhance adhesion of the resinous layer to be subsequently applied thereon.

The spherical shape of the carrier particles provides the carrier with a desirable fluidity.

The present carrier material has a specific gravity lower than iron and an apparent density comparable with that of the ferrite carrier. Therefore, with the present carrier, a relatively low level of developing torque is required in the machine and a satisfactory developer working life is provided.

The present magnetite carrier material has a saturation magnetization within the range of about 90–150 emu/g which falls between those of the iron and ferrite materials and will develop fine copies having an acceptable gradient.

The resinous coating layer makes the carrier material less sensitive to changes in the environmental conditions.

The spherical core material according to the invention may be prepared for example by partially reducing a mass of spherical magnetite particles with a stream of reducing gas such as hydrogen at an appropriate temperature in an oven such as a rotary kiln or a tunnel oven. The extent of reduction may be selected to give a reduced product having a desired proportion of metallic layer and an appropriate level of saturation magnetization.

The carrier according to the invention has a saturation magnetization in the range of about 90–150 emu/g, preferably about 100–130 emu/g. The saturation magnetization may be determined in a magnetometer, for example a sample-vibrating type Magnetometer VSMP-1 (ex. Toei Kogyo Co., Japan). It has been found that the present product exhibits maximum saturation magnetization in a magnetic field of about 14.5 KOe.

A saturation magnetization of less than 90 emu/g means that the proportion of the reduced metallic iron forming the outer surface layer of the magnetite core is insufficient for the purposes of the invention. On the other hand, a saturation magnetization above 150 emu/g means that the proportion of reduced metallic iron is excessive for the purposes of the invention.

Preferably the spherical carrier has an average particle size of 30–200$\mu$.

The reduced particulate material may be coated with a resinous material by dipping the material in a solution of such resinous material in a volatile organic solvent or by spraying the resinous solution over a fluidized bed of the particulate material.

Examples of organic solvents which may be used include methyl ethyl ketone, xylenes, n-butanol, methyl cyclohexane, methyl isobutyl ketone and toluene. The coated particulate material may be heated to an elevated temperature depending on the nature of the resinous material employed.

The nature of the resinous materials which may be used in the invention is not critical and they may be of any appropriate soluble type.

The amount of the resionus material to be applied to the particulate material is goverened by the nature of the resin employed and the type of copying machine (and hence the electrostatic and electric resistivity properties suitable for the machine) for which the product carrier is to be supplied.

Generally, the amount of applied resin suitable for the purpose of the invention will be in the range of 0.5–8%, preferably 1.5–6%, by weight of the partially reduced magnetite material.

The resin-coated carrier material according to the present invention may be used in conjunction with conventional toners such as those, for example, made from a natural resin, a synthetic resin, a blend of natural and synthetic resins or such a material modified by incorporation of any appropriate additives.

EXAMPLES

The invention will be illustrated with reference to the following non-limiting Examples.

EXAMPLE 1

A sample (100 kg) of a spherical magnetite material (particle size: 75–150μ, saturation magnetization: 80.5 emu/g, resistivity: $2.1\times10^6\Omega\cdot$cm, apparent density: 2.48 g/cm$^3$) was heated to 600° C. under a nitrogen atmosphere in a batch-wise rotary kiln and then reduced by replacing the atmosphere with hydrogen gas for 6 hours. Then the hydrogen atmosphere was again replaced with nitrogen and the contents were allowed to cool to room temperature. The reduced product had an apparent density of 2.40 g/cm$^3$, a saturation magnetization of 125.6 emu/g and a resistivity of less than $10^4\Omega\cdot$cm.

A portion (10 kg) of the product was charged into a fluidized bed type coating apparatus. A toluene solution (3 kg; solids content: 5%) of a styrene-acrylate resin ("MH-7015" ex. Fujikura Kasei Co.) was sprayed over the fluidized bed of material at 70° C. Then the temperature was raised to 100° C. for 30 minutes to thermally treat the coated material. The thus prepared carrier had an apparent density of 2.38 g/cm$^3$, a saturation magnetization of 122.0 emu/g, and an electric resisitivity of $10^9\Omega\cdot$cm.

A sample of the resin-coated carrier (1,000 g) was mixed with a commercially available toner for magnetic brush process (30 g; exhibiting negative polarity) in a 1 liter stainless steel V-mixer at 37 r.p.m. for 15 minutes to give a developer.

The developer was used to develop a latent electrostatic image formed on an Se photoconductor under conditions of 25° C. and 60% R.H. The resulting copies were sharp and free of fog and had an excellent gradient and a high resolution. The developer was allowed to stand under condiitons of 35° C./85% R.H. for 16 hours and again used to give similar results. The copying test under the latter conditions was then continued to assess the durability of the developer. It was found that the initial copy quality was maintained even after reproduction of 20,000 copies.

COMPARATIVE EXAMPLE 1

A sample (100 kg) of a spherical magnetic material (particle size: 75–150μ, saturation magnetization: 80.5 emu/g, resistivity: $2.1\times10^6\Omega\cdot$cm, apparent density: 2.48 g/cm$^3$) was heated to 600° C. under a nitrogen atmosphere in a batch-wise rotary kiln and then reduced by replacing the atmosphere with hydrogen gas for 1 hour. Then the hydrogen atmosphere was again replaced with nitrogen and the contents were allowed to cool to room temperature. The reduced product had an apparent density of 2.45 g/cm$^3$, a saturation magnetization of 88.5 emu/g, and a resistivity of $2.0\times10^4\Omega\cdot$cm.

A portion of the product was coated with a resinous material in accordance with the coating procedure described in Example 1. The thus prepared carrier had an apparent density of 2.43 g/cm$^3$, a saturation magnetization of 85.0 emu/g and a resistivity of $4.2\times10^9$ cm.

From the resin-coated carrier a developer was formulated as described in Example 1.

The developer was used in a developing test as described in Example 1. Under conditions of ambient temperature and humidity, the developer prepared gave clear and sharp copies free of fog and having an excellent gradient and a high resolution. In another experiment, the carrier was allowed to stand for 16 hours under conditions of 35° C./85% R.H. and then tested similarly. The thus aged developer gave obscure and foggy copies of a decreased gradient.

COMPARATIVE EXAMPLE 2

A sample (100 kg) of a spherical magnetite material (particle size range: 75–150) as used in Example 1 was reduced at 700° C. for 6 hours in the manner described in Example 1. The reduced product had an apparent density of 2.35 g/cm$^3$, a saturation magnetization of 171.0 emu/g and a resistivity of $10^4$ cm.

A portion (10 kg) of the product was charged into a fluidized bed type coating apparatus. A toluene solution (3 kg; solids content: 5%) of a styrene-acrylate resin ("MH 7015" ex. Fujikura Kasei Co.) was sprayed over the fluidized bed of material at 70° C. Then the temperature was raised to 100° C. for 30 minutes to thermally treat the coated material. The thus prepared resin-coated carrier had an apparent density of 2.31 g/cm$^3$, a saturation magnetization of 164.2 emu/g and a resistivity of $3.8\times10^9$ cm.

From this carrier, a develop was prepared as in Example 1.

The developer was used at ambient temperature and humidity in a developing test as described in Example 1. The resulting copies were not sharp, had a low gradient and contained brush-lines in the solid portions thereof.

EXAMPLE 2

A sample (100 kg) of a spherical magnetite material (particle size range: 30–60μ, apparent density: 2.3 g/cm$^3$, saturation magnetization: 74.2 emu/g, resistivity: $6.5\times10^6\Omega\cdot$cm) was reduced at 600° C. for 4 hours in the manner described in Example 1. The resulting product had an apparenat density of 2.1 g/cm$^3$, a saturation magnetization of 115.5 emu/g and a resistivity of less than $10^4\Omega\cdot$cm.

A portion (10 kg) of the reduced product was charged into a fluidized bed type coating apparatus. A toluene solution (3 kg; solids content: 5%) of an acrylic resin ("BR-83" ex. Mitsubishi Rayon Co.) was sprayed over the fluidized bed of material at 70° C. Then, the temperature was raised to 100° C. for 30 minutes to thermally treat the coated material. The coated material had an apparent density of 2.0 g/cm$^3$, a saturation magnetization of 110.2 emu/g and a resistivity of slightly greater than $10^{14}\Omega\cdot$cm.

A sample of the coated material (1,000 g) was mixed with a commercially available toner for magnetic brush processes (80 g, exhibiting negative polarity) in a 1 liter stainless steel V-mixer at 37 r.p.m. for 15 minutes to give a developer.

The developer as prepared was used at ambient temperature and humidity in a developing test as described in Example 1. The resulting copies were sharp and free of fog and had an excellent gradient and a high resolution.

The developer was further used at ambient temperature and humidity to reproduce 80,000 copies. Even after this, the initial copy quality was found to have been substantially maintained.

EXAMPLE 3

A sample (100 kg) of a spherical magnetite material (particle size range: 40–75μ, apparent density: 2.2 g/cm$^3$, saturation magnetizaiton: 84.5 emu/g, resistivity: $1.6\times10^{6}\Omega\cdot$cm) was reduced at 600° C. for 5 hours in the manner described in Example 1. The reduced product had an apparent density of 2.1 g/cm$^3$, a saturation magnetization of 110.4 emu/g and a resistivity of slightly less than $10^{4}\Omega\cdot$cm.

A portion of the reduced product (10 kg) was charged into a fluidized bed type coating apparatus. A methyl ethyl ketone solution (6 kg; solids content: 4%) of a fluorine resin (Du Pont; "Teflon" S954–101) was sprayed over the fluidized bed of material at 40° C. Then the temperature was raised to 350° C. for 30 minutes to bake the coated material. The thus coated product carrier had an apparent density of 2.3 g/cm$^3$, a saturation magnetization of 106.2 emu/g and a resistivity of $2.3\times10^{11}\Omega\cdot$cm.

A sample of the coated carrier (1,000 g) was mixed with a commercially available toner for magnetic brush processes (40 g; exhibiting positive polarity) in a 1 liter stainless steel V-mixer at 37 r.p.m. for 10 minutes to give a developer.

The thus formulated developer was used to develop a latent electrostatic image formed on an OPC photoconductor. The resulting copies were sharp and free of fog and had an excellent gradient and a high resolution. This initial copy quality was substantially maintained even after reproduction of 80,000 copies. The carrier which had been aged at a high humidity as described in the preceding Examples gave copies of a quality similar to that achieved by the unaged developer.

What is claimed is:

1. A method of preparing a resinous particulate carrier material useful in conjunction with a toner for preparing a two-component electrophotographic developer and consisting essentially of a core having a spherical body of magnetite surrounded by an outer surface layer comprising metallic iron and a resinous coating layer covering the core, said method comprising the steps of:

partially reducing a particulate magnetite material in a substantially spherical form with a gaseous reducing agent to provide a layer of reduced metallic iron on the surface of said spherical magnetite material to the extent that the partial reduction is effected to such an extent that the product carrier exhibits a saturation magnetization in the range of about 90 to 150 emu/g; and coating the thus partially reduced magnetite material with a resinous material.

2. A method according to claim 5 wherein the partial reduction is effected to such an extent that the product carrier exhibits a saturation magnetization in the range of about 100 to about 130 emu/g.

3. A method according to claim 1 wherein said resinous material is applied to said reduced magnetite material in such a controlled thickness that the product carrier has an electric resistivity inperted thereto which is suitable for the particular electrophotographic developing system in which it will be employed.

* * * * *